US006047254A

United States Patent [19]

Ireton et al.

[11] Patent Number: 6,047,254

[45] Date of Patent: Apr. 4, 2000

[54] SYSTEM AND METHOD FOR DETERMINING A FIRST FORMANT ANALYSIS FILTER AND PREFILTERING A SPEECH SIGNAL FOR IMPROVED PITCH ESTIMATION

[75] Inventors: Mark A. Ireton; John G. Bartkowiak, both of Austin, Tex.

[73] Assignee: Advanced Micro Devices, Inc., Sunnyvale, Calif.

[21] Appl. No.: 08/957,099

[22] Filed: Oct. 24, 1997

Related U.S. Application Data

[63] Continuation-in-part of application No. 08/647,843, May 15, 1996, Pat. No. 5,937,374.

[51] Int. Cl.[7] ..... G10L 19/02

[52] U.S. Cl. ..... 704/209; 704/207

[58] Field of Search ..... 704/204, 207, 704/209, 219, 220

[56] References Cited

U.S. PATENT DOCUMENTS

| | | | |
|---|---|---|---|
| 3,787,778 | 1/1974 | Carre et al. | 330/86 |
| 4,128,737 | 12/1978 | Dorais | 704/265 |
| 4,301,328 | 11/1981 | Dorais | 704/267 |
| 4,433,210 | 2/1984 | Ostrowski et al. | 704/265 |
| 4,470,150 | 9/1984 | Ostrowski | 704/261 |
| 4,544,919 | 10/1985 | Gerson | 341/75 |
| 4,680,797 | 7/1987 | Benke | 704/211 |
| 4,813,076 | 3/1989 | Miller | 704/254 |
| 4,817,157 | 3/1989 | Gerson | 704/230 |
| 4,820,059 | 4/1989 | Miller et al. | 704/254 |
| 4,879,748 | 11/1989 | Picone et al. . | |
| 4,890,328 | 12/1989 | Prezas et al. | 704/223 |
| 4,896,361 | 1/1990 | Gerson | 704/222 |
| 4,912,764 | 3/1990 | Hartwell et al. | 704/261 |
| 5,018,200 | 5/1991 | Ozawa | 704/222 |
| 5,414,796 | 5/1995 | Jacobs et al. | 704/221 |
| 5,491,771 | 2/1996 | Gupta et al. . | |
| 5,567,420 | 10/1996 | Jacobs et al. | 424/60 |
| 5,577,160 | 11/1996 | Hosom et al. | 704/209 |
| 5,596,676 | 1/1997 | Swaminathan et al. | 704/208 |
| 5,629,955 | 5/1997 | McDonough | 375/200 |
| 5,812,966 | 9/1998 | Byun et al. . | |

OTHER PUBLICATIONS

Rabiner & Schafer "Digital Processing Of Speech Signals," Chapter 8—Linear Predictive Coding of Speech, Prentice Hall, Signal Processing Series, pp. 396–461.

"Short Time Analysis: Pitch Estimation Using SIFT", Computer Project for Speech Processing ECEN 5753 Spring 1997, Oklahoma State University, 5 pages (see http://spif-f.ecen.okstate.edu/CLASSES/ECEN5753/ASGN/Pitch-_SIFT_Asgn.html).

ICASSP 82 Proceedings, May 3, 4, 5 1982, Palais Des Congres, Paris, France, Sponsored by the Institute of Electrical and Electronics Engineers, Acoustics, Speech, and Signal Processing Society, vol. 2 of 3, IEEE International Conference of Acoustics, Speech and Signal Processing, pp. 651–654.

*Primary Examiner*—Krista M. Zele
*Assistant Examiner*—Michael N. Opsasnick
*Attorney, Agent, or Firm*—Conley, Rose & Tayon PC; Jeffrey C. Hood

[57] ABSTRACT

The present invention comprises an improved vocoder system and method for estimating the pitch of a speech signal. The speech signal comprises a stream of digitized speech samples. The speech samples are partitioned into frames. For each frame of the speech signal, an optimal order-two inverse filter is determined. The optimal order-two inverse filter is determined by computing an order-two inverse filter at various locations within the speech frame. For each order-two inverse filter an energy value is calculated which represents the proportion of energy which would remain if the speech signal were filtered with the order-two inverse filter. The order-two inverse filter which minimizes the energy proportion is chosen to be the optimal order-two inverse filter. The optimal order-two inverse filter is then used to filter the samples of the speech frame. An autocorrelation is performed on the filtered signal for a range of tine-delay values. The peaks of the autocorrelation function are analyzed to determine the pitch period.

17 Claims, 8 Drawing Sheets

Representation of speech signals.

Range of bit rates for various types of speech representations.

Source-system model of speech production.

General discrete-time model for speech production.

Block diagram of simplified model for speech production.

Pitch Estimation Method According to the Present Invention

SYSTEM AND METHOD FOR DETERMINING A FIRST FORMANT ANALYSIS FILTER AND PREFILTERING A SPEECH SIGNAL FOR IMPROVED PITCH ESTIMATION

CONTINUATION DATA

This is a continuation-in-part of application Ser. No. 08/647,843 titled "System and Method for Improved Pitch Estimation Which Performs First Formant Energy Removal For A Frame Using Coefficients From A Prior Frame" filed May 15, 1996 now patented May 10, 1999 Pat. No. 5,937,374 whose inventors are John G. Bartkowiak and Mark A. Ireton.

FIELD OF THE INVENTION

The present invention relates generally to a vocoder which receives speech waveforms and generates a parametric representation of the speech waveforms, and more particularly to an improved vocoder system and method for performing pitch estimation.

DESCRIPTION OF THE RELATED ART

Digital storage and transmission of voice or speech signals has become increasingly prevalent in modern society. Digital storage of a speech signal comprises generating a digital representation of the speech signal and then storing the digital representation in memory. As shown in FIG. 1, a digital representation of a speech signal can generally be either a waveform representation or a parametric representation. A waveform representation of a speech signal comprises preserving the "waveshape" of the analog speech signal through a sampling and quantization process.

A parametric representation of a speech signal implies the choice of a model for speech production. The output of the model is governed by a set of parameters which evolve in time. A parametric representation aims at specifying the time-evolution of the model parameters so that the given speech signal is achieved as the model output. Thus a parametric representation of a speech signal is accomplished by generating a digital waveform representation using speech signal sampling and quantization, and then further processing the digital waveform to determine the parameters of the speech production model, or more precisely, the discrete-time evolution of these parameters. The parameters of the speech production model are generally classified as either excitation parameters, which are related to the source of the speech excitation, or vocal tract response parameters, which are related to the physical/acoustic modulation of the speech excitation by the vocal tract.

FIG. 2 illustrates a comparison of waveform representations and parametric representations of speech signals according to the data transfer rate required for real-time transmission. As shown, parametric representations of speech signals require a lower data rate, or number of bits per second, than waveform representations. A waveform representation requires from 15,000 to 200,000 bits per second to represent and/or transfer a typical speech signal, depending on the type of quantization and modulation used. A parametric representation requires a significantly lower number of bits per second, generally from 500 to 15,000 bits per second. In general, a parametric representation is a form of speech signal compression which uses a priori knowledge of the characteristics of the speech signal in the form of a speech production model. The speech production model is a model based on human speech production anatomy. A parametric representation of a speech signal specifies the time-evolution of the model parameters so that the speech signal is realized as the model output.

Speech sounds can generally be classified into three distinct classes according to their mode of excitation. Voiced sounds are sounds produced by vibration or oscillation of the human vocal chords, thereby producing quasi-periodic pulses of air which excite the vocal tract. Unvoiced sounds are generated by forming a constriction at some point in the vocal tract, typically near the end of the vocal tract at the mouth, and forcing air through the constriction at a sufficient velocity to produce turbulence. This creates a broad spectrum noise source which excites the vocal tract. Plosive sounds result from creating pressure behind a closure in the vocal tract, typically at the mouth, and then abruptly releasing the air.

A speech production model can generally be partitioned into three phases comprising vibration or sound generation within the glottal system, propagation of the vibrations or sound through the vocal tract, and radiation of the sound at the mouth and to a lesser extent through the nose. FIG. 3 illustrates a simplified model of speech production which includes an excitation generator for sound excitation and a time varying linear system which models propagation of sound through the vocal tract and radiation of the sound at the mouth. Therefore, this model separates the excitation features of sound production from the vocal tract and radiation features. The excitation generator creates a signal comprising either (a) a train of glottal pulses as the source of excitation for voiced sounds, or (b) randomly varying noise as the source of excitation for unvoiced sounds. The time-varying linear system models the various effects of the vocal tract on the sound excitation. The output of the speech production model is determined by a set of parameters which affect the operation of the excitation generator and the time-varying linear system.

Referring now to FIG. 4, a more detailed speech production model is shown. As shown, this model includes an impulse train generator for generating an impulse train corresponding to voiced sounds, and a random noise generator for generating random noise corresponding to unvoiced sounds. One parameter of the speech production model is the pitch period, which is supplied to the impulse train generator to control the instantaneous spacing of the impulses in the impulse train. Over short time intervals the pitch parameter does not change significantly. Thus the impulse train generator produces an impulse train which is approximately periodic (with period equal to the pitch period) over short time intervals. The impulse train is provided to a glottal pulse model block which models the glottal system. The output from the glottal pulse model block is multiplied by an amplitude parameter $A_v$ and provided through a voiced/unvoiced switch to a vocal tract model block. The random noise output from the random noise generator is multiplied by an amplitude parameter $A_N$ and is provided through the voiced/unvoiced switch to the vocal tract model block. The voiced/unvoiced switch controls which excitation generator is connected to the time-varying linear system. Thus, the voiced/unvoiced switch receives an input parameter which determines the state of the voiced/unvoiced switch.

The vocal tract model block generally relates the volume velocity of the speech signal at the source to the volume velocity of the speech signal at the lips. The vocal tract model block receives vocal tract parameters which determine how the source excitation (voiced or unvoiced) is transformed within the vocal tract model block. In particular, the vocal tract parameters determine the transfer function V(z) of the vocal tract model block. The resonant frequencies of the vocal tract, which correspond to the poles of the transfer function V(z), are referred to as formants. The output of the vocal tract model block is provided to a radiation model which models the effect of pressure at the lips on the speech signals. Therefore, FIG. 4 illustrates a general discrete-time model for speech production. The model parameters, including pitch period, voiced/unvoiced selection, voiced amplitude $A_v$, unvoiced amplitude $A_N$, and the vocal tract parameters, control the operation of the speech production model. As the model parameters evolve in time, a synthesized speech waveform is generated at the output of the speech production model.

Referring now to FIG. 5A, in some cases it is desirable to combine the glottal pulse, radiation, and vocal tract model blocks into a single transfer function. This single transfer function is represented in FIG. 5A by the time-varying digital filter block. As shown, an impulse train generator and random noise generator each provide outputs to a voiced/unvoiced switch. The output u(n) from the switch is multiplied by gain parameter G, and the resultant product Gu(n) is provided as input to the time-varying digital filter. The time-varying digital filter performs the operations of the glottal pulse model block, vocal tract model block, and radiation model block shown in FIG. 4. The output s(n) of the time-varying digital filter comprises a synthesized speech signal.

The time-varying digital filter of FIG. 5A obeys the recursive expression $$s(n) = \sum_{k=1}^{p} a_k s(n-k) + G \cdot u(n) \tag{1}$$

which is particularly amenable to a development of linear predictive coding. In the z-domain, the time-varying digital filter has the following transfer function:

$$H(z) = \frac{S(z)}{U(z)} = \frac{G}{1 - \sum_{k=1}^{p} a_k z^{-k}}, \tag{2}$$

wherein S(z) is the z-transform of the output sequence s(n), and U(z) is the z-transform of the signal u(n). This transfer function models the effect of the vocal tract on the source excitation u(n). In particular, the resonant frequencies of the vocal tract correspond to the maxima of the corresponding amplitude response $|H(e^{jw})|$, where ω is angular frequency. These resonant frequencies are referred to as formants. The model parameters, i.e. the pitch period P, gain G, and vocal tract parameters $a_k$, change very slowly in time compared to the synthesized speech signal s(n). Thus, for any short time-interval, the time-varying digital filter is excited by an impulse train which is approximately periodic with period equal to the pitch period:

$$u(n) = \sum_{k} \delta(n - kP + n_0),$$

where $n_0$ is an integer constant. And the synthesized speech output s(n) is also approximately periodic with the form $$s(n) = \sum_{k} h(n - kP + n_0)$$

where h(n) is the impulse response of the time-varying digital filter, and P is the pitch period.

Referring now to FIG. 5B, the synthesized speech output from the time-varying digital filter is plotted along with the impulse train excitation. The impulses comprising the impulse train u(n) are separated in time by a spacing equal to the pitch period. After the assertion of each impulse, the time-varying digital filter exhibits a corresponding impulse response. The portion of the synthesized speech signal s(n) between points denoted A and B comprises one complete impulse response. Observe that the impulse response resembles a decaying sinusoid. The frequency of this decaying sinusoid corresponds approximately to the first formant. Thus the time interval denoted T corresponds roughly to the first formant period.

In this framework, the problem of speech compression can be expressed as follows. Given a sampled speech signal, formally assume that the sampled speech signal was produced by the above model for speech production. Divide the sampled speech signal into short time blocks. For each speech block, estimate the coefficients $a_k$, the pitch period P, gain G, and the state of the voiced/unvoiced switch. Thus, one set of parameters is produced for each frame of speech data, and the speech signal is encoded as an ordered succession of parameter sets. Since the storage required for a parameter set is much smaller than the storage required for the corresponding speech block, a significant data compression is achieved.

The complementary problem of speech synthesis proceeds in the opposite direction. Given a succession of parameter sets which represent a speech signal, the speech signal is regenerated by supplying the parameter sets to the speech production model in natural order. The resulting blocks of synthesized speech represent the original speech signal.

Linear predictive coding is one of the most extensively used modern techniques for speech compression. Linear predictive coding can be motivated by considering the problem of designing a linear predictor $$\hat{s}(n) = \sum_{k=1}^{p} \alpha_k s(n-k) \tag{3}$$

to model a given speech signal s(n). (For reference, see Rabiner & Schafer, *Digital Processing of Speech Signals,* Chapter 8). Since the linear predictor ŝ(n) is to model the speech signal s(n), it is natural to define an error signal e(n)=s(n)−ŝ(n). Substituting the linear predictor expression into the error signal definition, the error signal assumes the form $$e(n) = s(n) - \sum_{k=1}^{p} \alpha_k s(n-k). \tag{4}$$

It is apparent that equation (4) has the form of an FIR filter. Recall that the speech signal s(n) is assumed to be realized by the speech production model: thus the speech signal s(n) conforms to equation (1) for some set of coefficients $a_k$. Substituting expression (1) for the speech signal s(n) into (4), it follows that $$e(n) = G \cdot u(n) + \sum_{k=0}^{p} (a_k - \alpha_k) \cdot s(n-k).$$

Clearly, if the predictor parameters $a_k$ were exactly equal to the model parameters $a_k$, then the error signal would be proportional to u(n), i.e.

$$e(n)=Gu(n).$$

In other words, the FIR filter (4) is an inverse filter for the time-varying digital filter (1), when $a_k=a_k$. This observation becomes transparent when the FIR filter (4) is described in the z-domain as:

$$A(z) = \frac{E(z)}{S(z)} = 1 - \sum_{k=1}^{p} \alpha_k z^{-k}, \tag{5}$$

where E(z) is the z-transform of the error signal e(n). Observe that the transfer function A(z) exactly coincides with the denominator of H(z) when $a_k=a_k$. In practice, natural speech signals are not exactly realizable in terms of the speech production model and equation (1). Thus it is impossible to design an exact inverse filter. Nevertheless, an approximate inverse filter A(z) has the same qualitative behavior as the ideal inverse filter. The approximate inverse filter A(z) compensates for the spectral shaping due to transfer function H(z). In particular, the approximate inverse filter significantly attenuates spectral components in the speech signal which are near the formant frequencies. Thus the error signal has a power spectrum which is flat compared to the speech signal spectrum. Since spectral components near the pitch frequency are preserved by the approximate inverse filter, the error signal more clearly manifests the periodicity due to the pitch.

Given a block of speech samples $\{s(n)\}_{n=0}^{N-1}$ of length N, according to linear predictive coding theory, the best predictor coefficients $a_k$ are those which minimize the energy of the error signal as given by the expression $$\sum_{m=0}^{N-1+p} [s(m) - \hat{s}(m)]^2.$$

It is assumed that the speech samples s(m) are identically zero for values of the index m outside the range 0 to N−1 inclusive. By applying this minimum energy criteria, a system of linear equations arise wherein the coefficients $a_k$ are expressed as the unknown parameters. The coefficients $a_k$ are determined by solving the following system of correlation equations:

$$\sum_{k=1}^{p} \alpha_k R(|i-k|) = R(i), \tag{6}$$

where i takes the values 1, 2, 3, . . . , p. The constants R(k) are autocorrelation values given by the expression $$R(k) = \sum_{m=0}^{N-1-k} s(m)s(m+k). \tag{7}$$

This method for solving for the predictor parameters $a_k$ define the so-called autocorrelation method.

Alternately, the error energy can be expressed in the slightly different form $$\sum_{m=0}^{N-1} [s(m) - \hat{s}(m)]^2.$$

Note that the upper index of summation has been fixed at N−1. In this case the resulting linear system has the form:

$$\sum_{k=1}^{p} \alpha_k \phi(i,k) = \phi(i,0), \tag{9}$$

output from the inverse filter more clearly displays the periodicity due to the pitch. Thus it is desirable to use the filtered signal from the inverse filter in the correlation analysis instead of the original speech signal.

Thus, many prior art pitch detection systems have the following structure. First, a speech signal is analyzed to determine an inverse filter A(z). This involves performing an LPC analysis on the speech signal. Second, the speech signal is filtered using the inverse filter A(z). Third, an autocorrelation is performed on the filtered signal. The autocorrelation is performed for a range of time-delay values which span the feasible range for the pitch period. Since the spectral components near the formant frequencies are attenuated by the inverse filter A(z), the autocorrelation peaks due to the formants are reduced compared to the peaks due to the pitch period and its multiples. A threshold is applied to the resulting autocorrelation function. The threshold is chosen so that the autocorrelation peaks due to the pitch period and its multiples exceed threshold, while the smaller amplitude peaks due to the formants fail to exceed the threshold.

For example, the Simple Inverse Filtering Tracking algorithm proposed by J. D. Markel has the basic structure described above. [See *The SIFT Algorithm for Fundamental Frequency Estimation,* IEEE Transactions on Audio and Electroacoustics, Vol. AU-20, No.5, pp.367–377, December 1972]. A block diagram of the SIFT algorithm is shown in FIG. 6. The SIFT algorithm uses a low-pass filter 610 with cutoff frequency approximately 900 Hz to filter an input speech signal. The low-pass filter 610 serves to eliminate all spectral components of the speech signal beyond the second formant; i.e. only the first and second formants are retained. The filtered signal is supplied to a decimator 612 with a 5:1 ratio, i.e. only every fifth sample is retained. The decimation effectively reduces the sampling rate from 10 KHz to 2 KHz. An LPC analysis block 614 performs an LPC analysis on the decimated signal to estimate the parameters of inverse filter 616. Since the SIFT algorithm aims at modeling the first two formants, a order four (p=4) analysis is required. The four parameters resulting from the LPC analysis are supplied to the inverse filter 616. The inverse filter 616 performs the filtering indicated by transfer function (5) above. The inverse filtered signal is supplied to an autocorrelation unit 618. The autocorrelation unit 618 performs a short-time autocorrelation on the inverse filtered signal for a range of time-delay values. The peak of the short-time autocorrelation function is selected by and the values $\phi(i,k)$ are calculated according the expression $$\phi(i, k) = \sum_{m=-k}^{N-k-1} s(m)s(m+k-i). \tag{10}$$

This alternate method for solving for the predictor parameters $a_k$ define the so-called covariance method.

As mentioned above, synthesized speech from the speech production model is approximately periodic over short time-intervals with period equal to the pitch period. For any periodic signal, it is a well known fact that the autocorrelation function achieves an absolute maximum value at time delays equal to the fundamental period and its integer multiples. These facts motivate the use of autocorrelation to detect the pitch period of natural speech. Due to the locally periodic nature of speech, a high value for the correlation function will register at multiples of the pitch period, i.e. at 2, 3, 4, and 5 times the pitch period, producing multiple peaks in the correlation. Ostensibly, the problem of pitch period detection is one of identifying a series of large amplitude correlation peaks which have this regular time-delay structure. Namely, the large amplitude peaks must line up with time-delays that are 2, 3, 4, and 5 times some fundamental time-delay. The pitch period is then equal to this fundamental time-delay.

In practice, the autocorrelation analysis is complicated by the fact that some speech signals have a particularly strong (high energy) first formant which results in a pronounced peak in the autocorrelation function. Empirical studies of speech reveal that the pitch achieves frequencies as high as 500 Hz, while the first formant can achieve frequencies as low as 350 Hz. In terms of period, the pitch achieves periods as low as 2.00 msec, while the first formant achieves periods as high as 2.86 msec. Thus, when the first formant has high energy and achieves a period larger than 2.00 msec, the autocorrelation peak due to the first formant can very easily be confused with the pitch peak. Pitch estimation errors in speech have a highly damaging effect on reproduced speech quality. Therefore, techniques which reduce the contribution of the first formant and other secondary excitations to the pitch estimation method are widely sought.

In view of the fact that the inverse filter A(z) attenuates spectral components near the formant frequencies, it is desirable to pre-filter the speech signal using the inverse filter. Since, spectral components near the pitch frequency are relatively unmodified (un-attenuated), the peak detection unit 620. An interpolator 622 interpolates the values of the autocorrelation function around the location of the peak in order to define the selected peak with more precision. Finally, the signal is asserted to be unvoiced [U] if the peak amplitude falls below a predefined threshold, and asserted to be voiced [V] otherwise.

Since the SIFT algorithm aims at modeling the first two formants, it uses an order four inverse filter analysis. In general, a filter with four poles can realize a frequency response with two local maxima. However, an analysis of the power spectra of normal speech signals reveals that the first formant generally accounts for a large fraction of the speech signal energy, while the second and higher formants account for significantly smaller fractions of the total speech signal energy. Thus, an order four (p=4) LPC analysis spends considerable computational effort to model a second formant which accounts for a small fraction of the speech signal energy. As was mentioned above, the first formant is the only formant which can occur with frequencies low enough to be confused with the pitch in autocorrelation analyses. Thus, a method is needed which will focus exclusively on modeling the first formant contribution to a speech signal. Such a method, because it aims at modeling only the first formant, will realize computational advantages over prior art methods which attempt to model first and higher formants.

SUMMARY OF THE INVENTION

The present invention comprises an improved vocoder system and method for estimating the pitch of a speech signal. The speech signal comprises a stream of digitized speech samples. The speech samples are partitioned into frames. For each frame of the speech signal, an optimal order-two inverse filter is determined. The optimal order-two inverse filter is determined by computing an order-two inverse filter at various locations within the speech frame. For each order-two inverse filter an energy value is calculated which represents the proportion of energy which would remain if the speech signal were filtered with the order-two inverse filter. The order-two inverse filter which minimizes the energy proportion is chosen to be the optimal order-two inverse filter. The optimal order-two inverse filter is then used to filter the samples of the speech frame. An autocorrelation is performed on the filtered signal for a range of time-delay values. The peaks of the autocorrelation function are analyzed to determine the pitch period.

The present invention focuses on modeling and filtering the contribution of only the first formant to the speech signal, and thus realizes computational gains over prior art pitch estimators which attempt to model and filter two or more formants.

In particular, the present invention employs an order-two FIR filter to model and filter the contribution of the first formant in the speech signal, whereas prior art pitch estimators employ filters with order four or more to model and filter the first and higher formants. Since the computational effort required to solve for the FIR filter coefficients is a polynomial function of the order, smaller filter orders are strongly favored. The present invention employs an order-two filter which is the minimal order for which a band-reject effect can be achieved. [A first order filter with real coefficients can achieve a high pass or low-pass effect, but not an intermediate frequency band-reject effect.]. Thus, the present invention achieves pitch estimators with less computational effort than prior art pitch estimators.

BRIEF DESCRIPTION OF THE DRAWINGS

A better understanding of the present invention can be obtained when the following detailed description of the preferred embodiment is considered in conjunction with the following drawings, in which.

Figure 1:
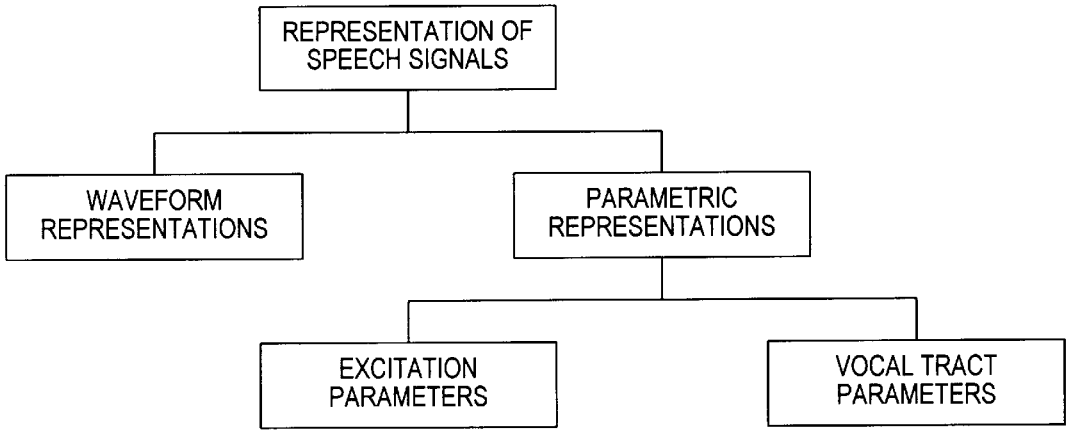
Fig. 1 (Prior Art)
FIG. 1 illustrates waveform representation and parametric representation methods used for representing speech signals.
Figure 2:
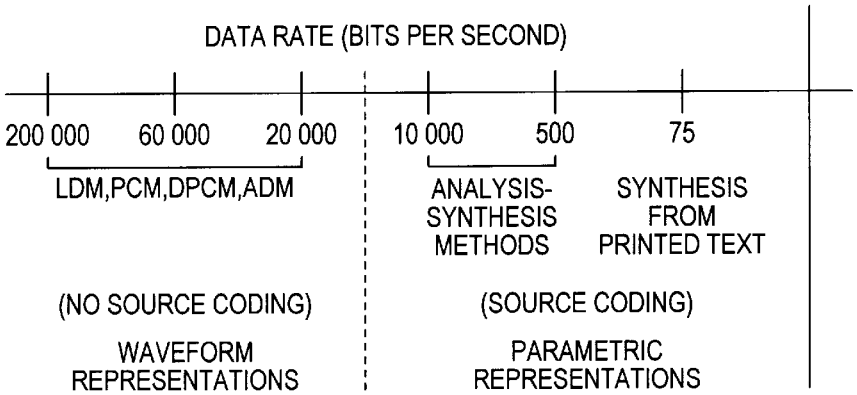
Fig. 2 (Prior Art)
FIG. 2 illustrates a range of bit rates required for the transmission of the speech representations illustrated in FIG. 1.
Figure 3:
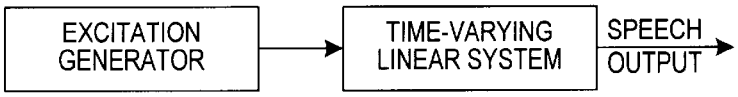
Fig. 3 (Prior Art)
FIG. 3 illustrates a basic model for speech production.
Figure 4:
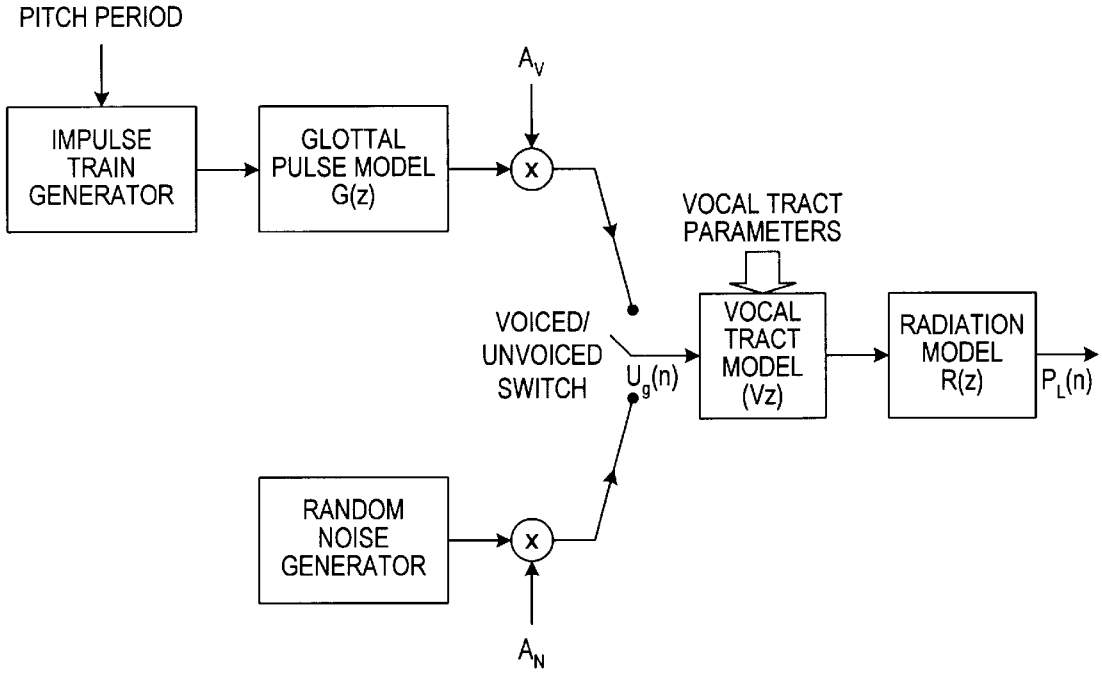
Fig. 4 (Prior Art)
FIG. 4 illustrates a generalized model for speech production.
Figure 5A:
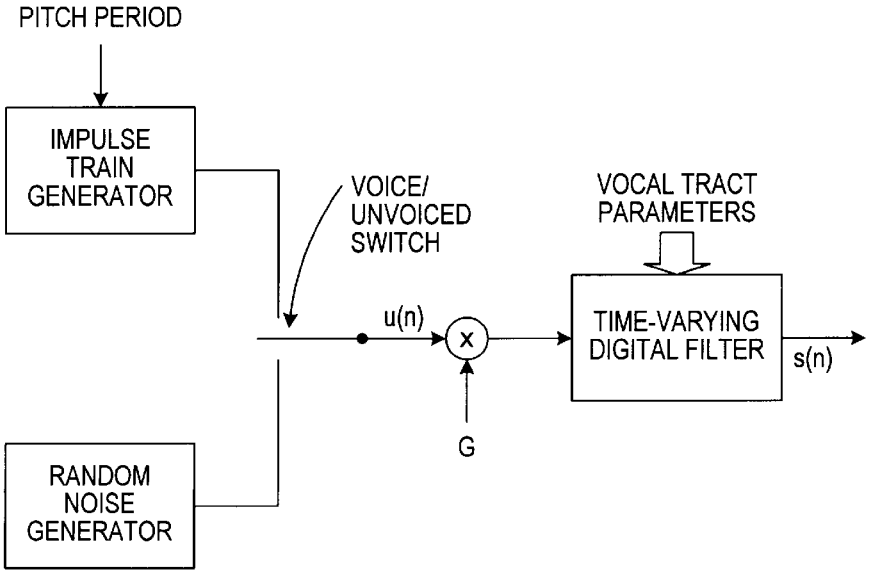
Fig. 5A (Prior Art)
FIG. 5A illustrates a model for speech production which includes a single time-varying digital filter.
Figure 5B:
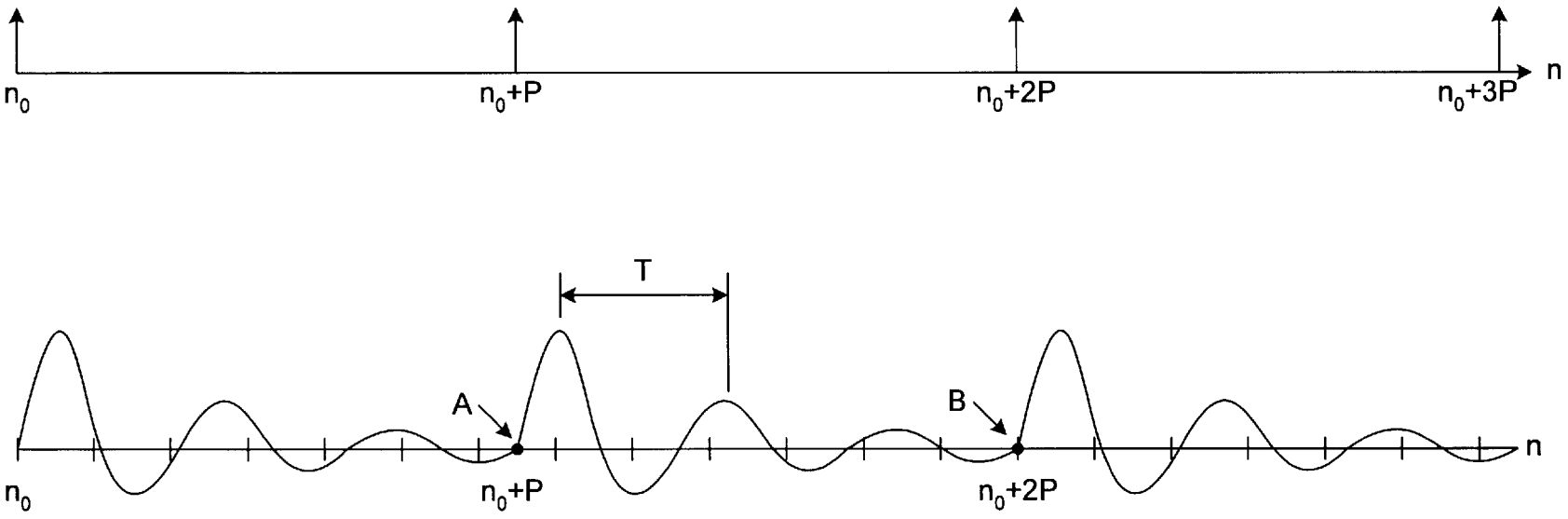
FIG. 5B illustrates the synthesized speech output from the time-varying digital filter along with the impulse train excitation according to the prior art.
Figure 6:
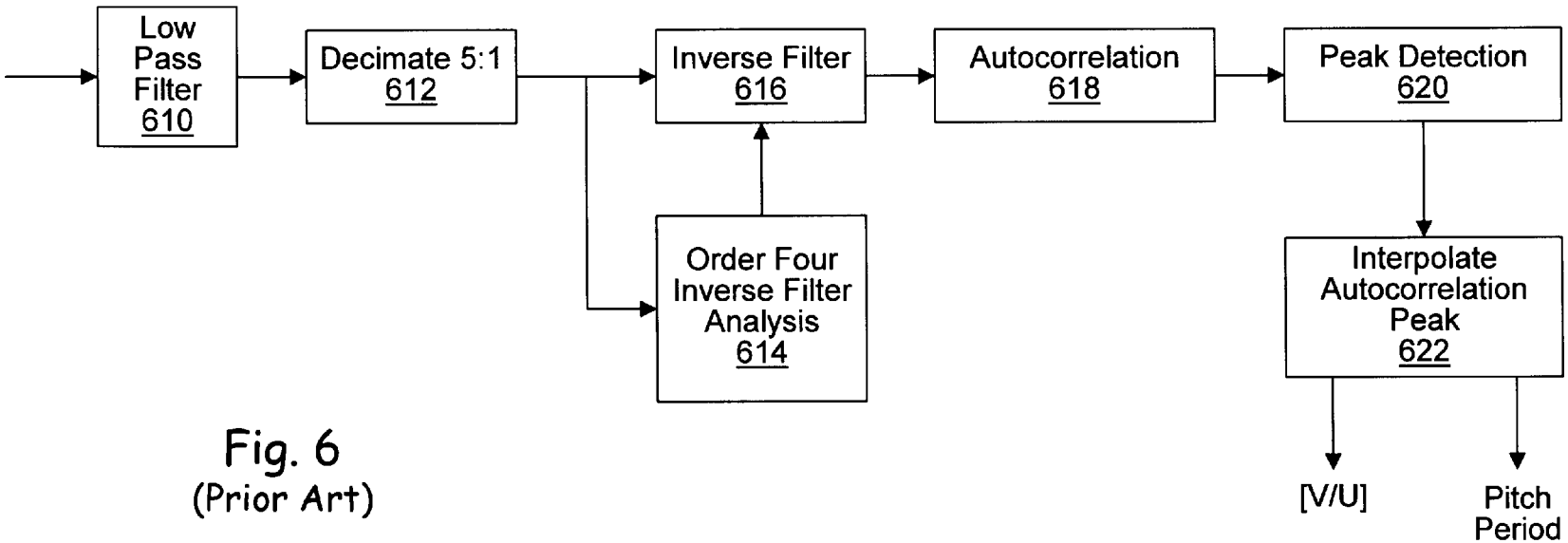
Fig. 6 (Prior Art)
FIG. 6 illustrates one prior art pitch detection algorithm known as Simple Inverse Filtering Tracking.

While the invention is susceptible to various modifications and alternative forms specific embodiments are shown by way of example in the drawings and will herein be described in detail. It should be understood however, that drawings and detailed description thereto are not intended to limit the invention to the particular form disclosed. But on the contrary the invention is to cover all modifications, equivalents and alternatives following within the spirit and scope of the present invention as defined by the appended claims.

DETAILED DESCRIPTION OF THE PREFERRED EMBODIMENT

Incorporation by Reference

For general information on speech coding, please see Rabiner and Schafer, "Digital Processing of Speech Signals", Prentice Hall, 1978 which is hereby incorporated by reference in its entirety.

Voice Storage and Retrieval System

Figure 7:
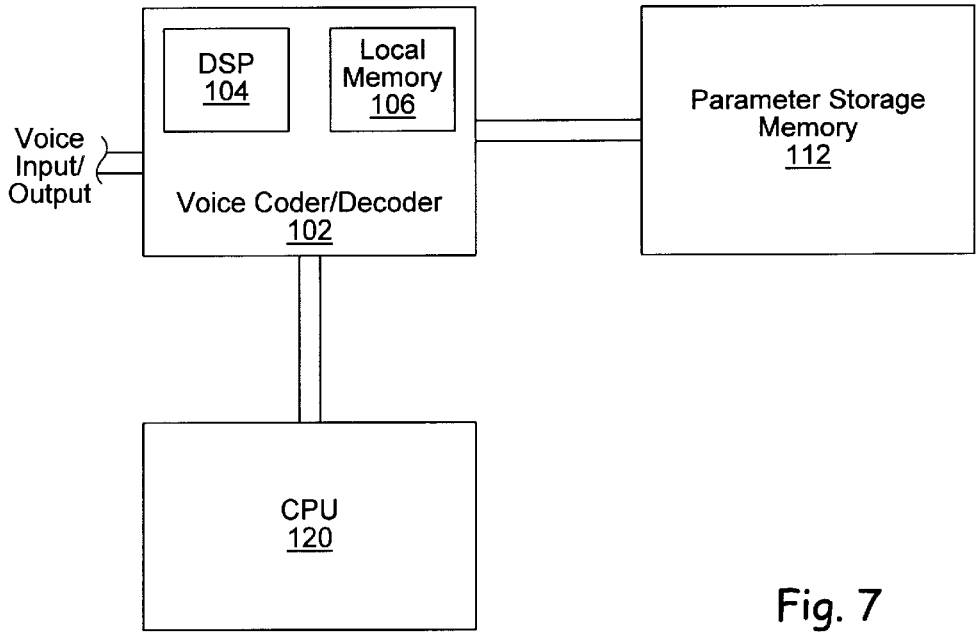
FIG. 7 is a block diagram of a speech storage system according to one embodiment of the present invention.

Referring now to FIG. 7, a block diagram illustrating a voice storage and retrieval system or vocoder according to one embodiment of the invention is shown. The voice storage and retrieval system shown in FIG. 7 can be used in various applications, including digital answering machines, digital voice mail systems, digital voice recorders, call servers, and other applications which require storage and retrieval of digital voice data. In the preferred embodiment, the voice storage and retrieval system is used in a digital answering machine.

As shown, the voice storage and retrieval system preferably includes a dedicated voice coder/decoder (vocoder or codec) 102. The voice coder/decoder 102 preferably includes one or more digital signal processors (DSPs) 104, and local DSP memory 106. The local memory 106 serves as an analysis memory used by the DSP 104 in performing voice coding and decoding functions, i.e., voice compression and decompression, as well as optional parameter data smoothing. The local memory 106 preferably operates at a speed equivalent to the DSP 104 and thus has a relatively fast access time. In the preferred embodiment, the DSP 104 analyzes speech data to determine a filter for first Formant removal according to the present invention.

The voice coder/decoder 102 is coupled to a parameter storage memory 112. The storage memory 112 is used for storing coded voice parameters corresponding to the received voice input signal. In one embodiment, the storage memory 112 is preferably low cost (slow) dynamic random access memory (DRAM). However, it is noted that the storage memory 112 may comprise other storage media, such as a magnetic disk, flash memory, or other suitable storage media. A CPU 120 is preferably coupled to the voice coder/decoder 102 and controls operations of the voice coder/decoder 102, including operations of the DSP 104 and the DSP local memory 106 within the voice coder/decoder 102. The CPU 120 also performs memory management functions for the voice coder/decoder 102 and the storage memory 112.

Alternate Embodiment

Figure 8:
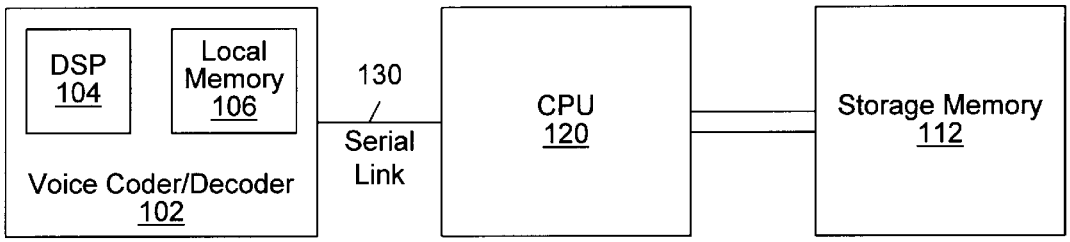
FIG. 8 is a block diagram of a speech storage system according to a second embodiment of the present invention.

Referring now to FIG. 8, an alternate embodiment of the voice storage and retrieval system is shown. Elements in FIG. 8 which correspond to elements in FIG. 7 have the same reference numerals for convenience. As shown, the voice coder/decoder 102 couples to the CPU 120 through a serial link 130. The CPU 120 in turn couples to the parameter storage memory 112 as shown. The serial link 130 may comprise a dumb serial bus which is only capable of providing data from the storage memory 112 in the order that the data is stored within the storage memory 112. Alternatively, the serial link 130 may be a demand serial link, where the DSPs 104A and 104B control the demand for parameters in the storage memory 112 and randomly accesses desired parameters in the storage memory 112 regardless of how the parameters are stored. The embodiment of FIG. 8 can also more closely resemble the embodiment of FIG. 7, whereby the voice coder/decoder 102 couples directly to the storage memory 112 via the serial link 130. In addition, a higher bandwidth bus, such as an 8-bit or 16-bit bus, may be coupled between the voice coder/decoder 102 and the CPU 120.

It is noted that the present invention may be incorporated into various types of voice processing systems having various types of configurations or architectures, and that the systems described above are representative only.

Encoding Voice Data

Figure 9:
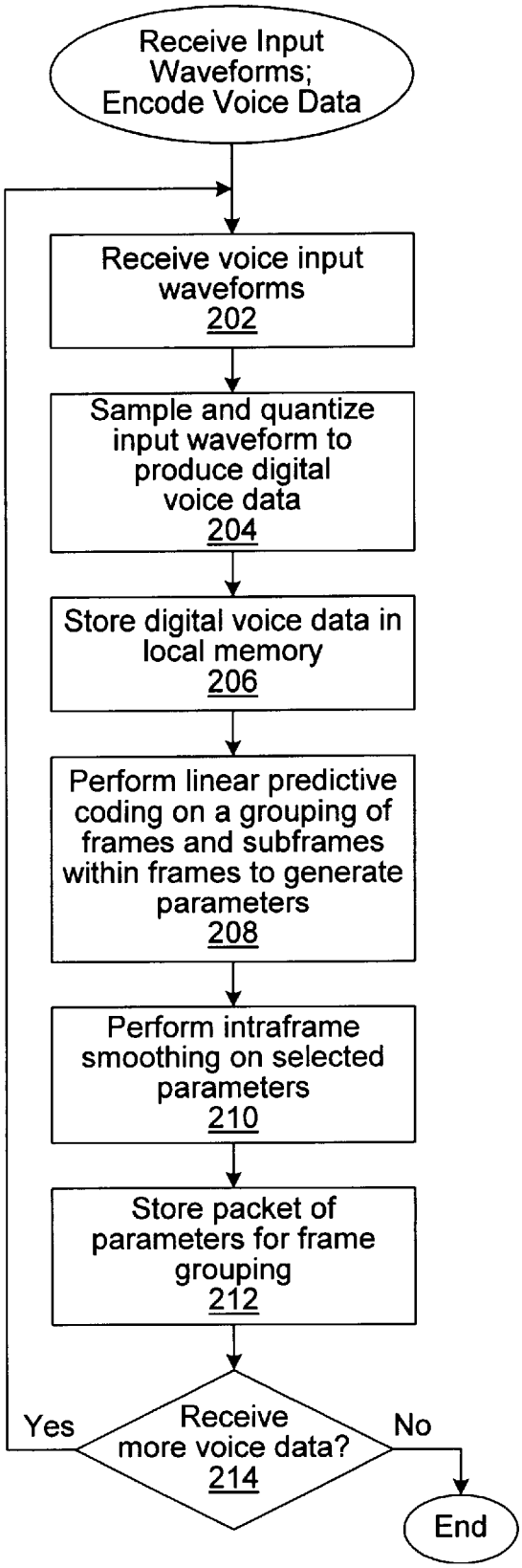
FIG. 9 is a flowchart diagram illustrating operation of speech signal encoding.

Referring now to FIG. 9, a flowchart diagram illustrating operation of the system of FIG. 7 encoding voice or speech signals into parametric data is shown. This figure illustrates one embodiment of how speech parameters are generated, and it is noted that various other methods may be used to generate the speech parameters using the present invention, as desired.

In step 202 the voice coder/decoder (vocoder) 102 receives voice input waveforms, which are analog waveforms corresponding to speech. In step 204 the vocoder 102 samples and quantizes the input waveforms to produce digital voice data. The vocoder 102 samples the input waveform according to a desired sampling rate. After sampling, the speech signal waveform is then quantized into digital values using a desired quantization method. In step 206 the vocoder 102 stores the digital voice data or digital waveform values in the local memory 106 for analysis by the vocoder 102.

While additional voice input data is being received, sampled, quantized, and stored in the local memory 106 in steps 202–206, the following steps are performed. In step 208 the vocoder 102 performs encoding on a grouping of frames of the digital voice data to derive a set of parameters which describe the voice content of the respective frames being examined. Various types of coding methods, including linear predictive coding, may be used. It is noted that any of various types of coding methods may be used, as desired. For more information on digital processing and coding of speech signals, please see Rabiner and Schafer, *Digital Processing of Speech Signals,* Prentice Hall, 1978, which is hereby incorporated by reference in its entirety. The present invention includes a novel system and method for calculating a first formant filter. Since the first formant filter has an order smaller than in prior art systems, the filter coefficients are calculated with less computational effort.

In step 208 the vocoder 102 develops a set of parameters for each frame of speech which represent the characteristics of the speech signal. This set of parameters includes a pitch parameter, a voiced/unvoiced parameter, a gain parameter, a magnitude parameter, and a multi-based excitation parameter, among others. The vocoder 102 may also generate other parameters which span a grouping of multiple frames.

Once these parameters have been generated in step 208, in step 210 the vocoder 102 optionally performs intraframe smoothing on selected parameters. In an embodiment where intraframe smoothing is performed, a plurality of parameters of the same type are generated for each frame in step 208. Intraframe smoothing is applied in step 210 to reduce this plurality of parameters of the same type to a single parameter of that type. However, as noted above, the intraframe smoothing performed in step 210 is an optional step which may or may not be performed, as desired.

Once the coding has been performed on the respective grouping of frames to produce parameters in step 208, and any desired intraframe smoothing has been performed on selected parameters in step 210, the vocoder 102 stores this packet of parameters in the storage memory 112 in step 212. If more speech waveform data is being received by the voice coder/decoder 102 in step 214, then operation returns to step 202, and steps 202–214 are repeated.

Figure 10:
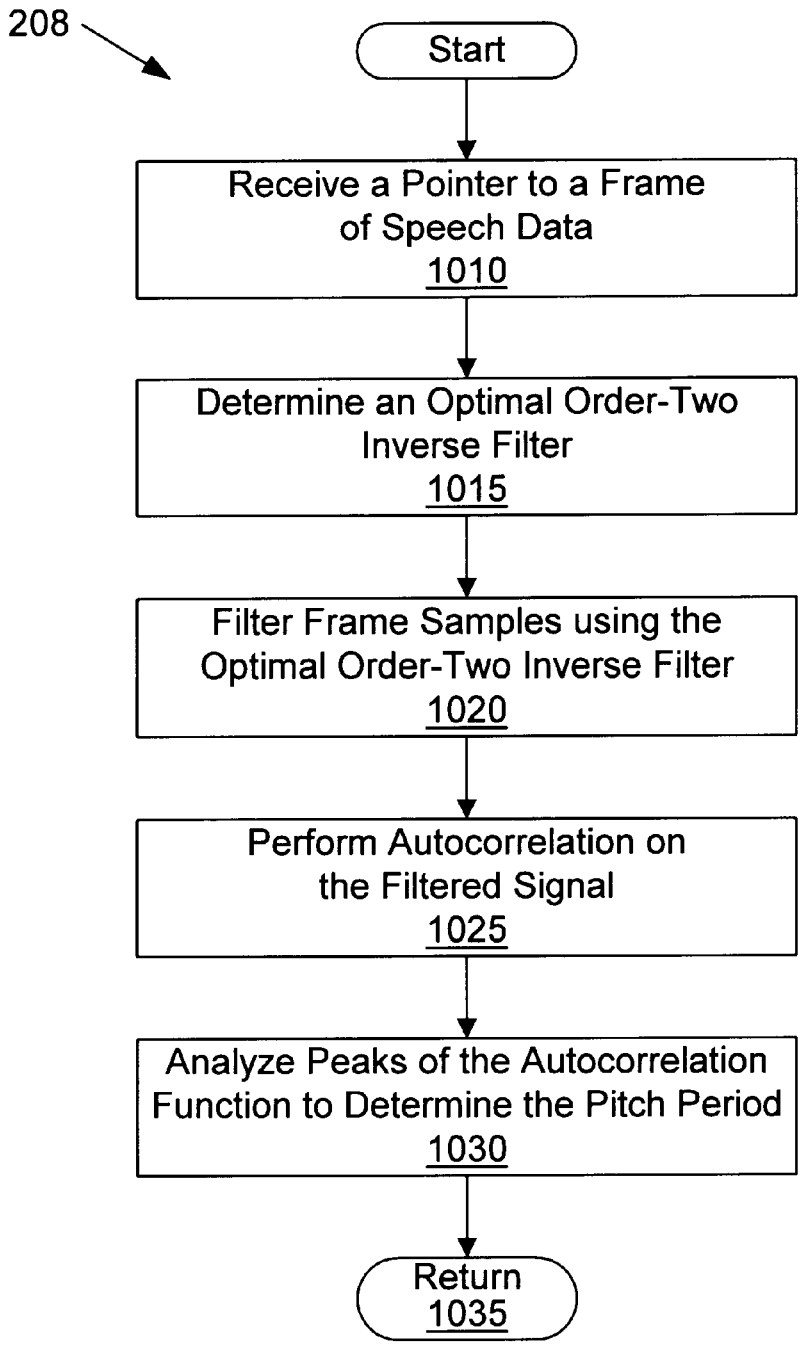
FIG. 10 is a flowchart illustrating the pitch estimation method according to the present invention.

FIG. 10—Pitch Estimation Method, First Embodiment

Referring now to FIG. 10, a block diagram is shown illustrating the pitch estimation method according to the present invention. The pitch estimation method comprises a part of step 208 of FIG. 9. The pitch estimation method operates on a frame of speech data stored in local memory 106. The frame comprises a set of consecutive samples of a speech waveform. Thus, in step 1010, the pitch estimation method commences with receiving a pointer InPtr to the speech frame. The pointer InPtr points to the first sample of the speech frame in local memory 106.

In step 1015, the samples of the speech frame are used to determine an optimal order-two inverse filter. The optimal order-two inverse filter has a transfer function A(z) given by $$A(z) = 1 - \hat{\alpha}_1 z^{-1} - \hat{\alpha}_2 z^{-2},$$

and thus is completely specified by the coefficients $\hat{a}_1$ and $\hat{a}_2$. The method for determining the optimal order-two inverse filter will be explained below. In step 1020, the samples of the speech frame are filtered using the optimal order-two inverse filter. In the time domain, the optimal order-two inverse filter has the following input/output relation:

$$y(n)=x(n)-\hat{a}_1x(n-1)-\hat{a}_2x(n-2),$$

where x(n) is the $n^{th}$ sample of speech frame, i.e. x(n)=* (InPtr+n), and y(n) is the filtered output. Since the frequency response $|A(e^{jw})|$ has a unique minimum amplitude and achieves this minimum at the first formant frequency, spectral components near the first formant frequency are significantly attenuated in the filtered signal y(n).

In step 1025, an autocorrelation is performed on the filtered signal y(n). Namely, the calculation $$R(\tau) = \sum_{n=0}^{N-1} y(n)y(n+\tau)$$

is performed for a range of integer time-delay values τ, where the integer N denotes the number of samples in the speech frame.

In step 1030, the peaks of the autocorrelation function are analyzed to determine the pitch period. In the preferred embodiment of the invention, step 1030 involves applying a threshold to the autocorrelation to determine autocorrelation peaks with sufficient amplitude. It is noted that by prefiltering the speech frame, the autocorrelation peak due to the first formant is attenuated sufficiently to fall below the threshold of the peak detection algorithm. In step 1035, control is returned to the parent process.

It was mentioned above that the speech frame for the pitch estimation method comprises consecutive samples of a speech waveform. The speech frame comprises at least two pitch periods worth of speech samples. This is to ensure capturing a complete expression of the speech waveform between two successive glottal pulses. It has been observed that the pitch period generally does not exceed 148 samples at an 8 KHz sampling rate. Thus, in the preferred embodiment, the speech frame comprises at least N=2×148=296 consecutive speech samples.

Now the process of calculating the optimal order-two inverse filter will be described, i.e., step 1015 of FIG. 10. In summary, step 1015 involves calculating a plurality of candidate order-two inverse filters and choosing the optimal order-two inverse filter based on an energy criterion. Each candidate order-two inverse filter is associated with a short segment of the speech frame. To illustrate the calculation of a candidate order-two inverse filter, suppose that an index I is specified. Define the short segment localized at index I as $$s_I(n)=x(n+I),$$

where index n runs from zero to M−1, and x() represents a sample of the speech frame. The size M of the short segment is chosen so that the short segment spans less than a pitch period in time duration. An order-two LPC analysis is performed on the short segment localized at index I. The LPC analysis produces coefficients $a_1$ and $a_2$ for an order-two inverse filter with transfer function $1-a_1z^{-1}-a_2z^{-2}$. Since, the short segment of speech data spans less than a pitch period in time duration, the order-two inverse filter obtained from the LPC analysis, and given by coefficients $a_1$ and $a_2$, will model the first formant energy but not the pitch energy.

From the coefficients $a_1$ and $a_2$, a pair of reflection coefficients $k_1$ and $k_2$ are calculated according to the relations $$k_1=a_1,$$

$$k_2 = \frac{\alpha_1}{1-\alpha_2}.$$

In terms of the reflection coefficients, an energy value E is calculated according to the equation $$E = (1-k_1^2)(1-k_2^2).$$

The energy value E represents the proportion of energy that would remain if the short segment were filtered with the order-two inverse filter given by coefficients $a_1$ and $a_2$. Observe that the order-two inverse filter and energy value depend on the value of index I.

In step 1015, the index I which minimizes the energy value E is located, and the candidate order-two inverse filter which corresponds to the minimizing index is declared to be the optimal order-two inverse filter. In particular, the index I is varied. For each value of the index I, a candidate order-two inverse filter is calculated on the short segment localized at index I; an energy value is calculated for the candidate order-two inverse filter. A search algorithm is employed to locate the index I which minimizes the energy value E.

Figure 11:
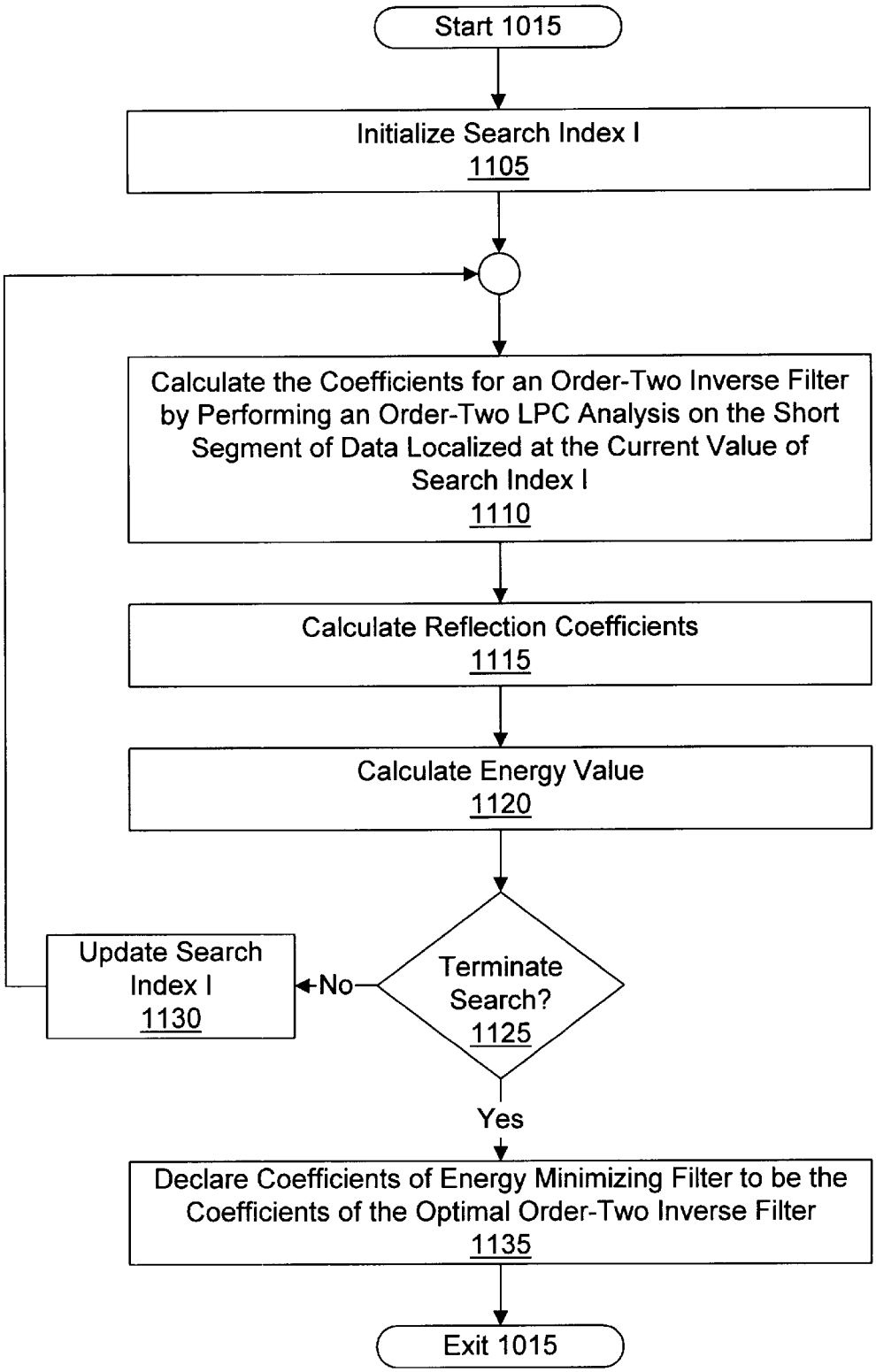
FIG. 11 is a flowchart which illustrates the step (1015 of FIG. 10) of determining an optimal order-two inverse filter.

Please refer now to FIG. 11 which presents a flowchart for step 1015 of FIG. 10. In step 1105, the search index I is initialized. In step 1110, a candidate order-two inverse filter is calculated for the short segment of speech data localized at index I. As mentioned above, an order-two LPC analysis is performed to calculate the coefficients $a_1$ and $a_2$ of the candidate order-two inverse filter. The LPC analysis may be performed by using (a) the covariance method, (b) the autocorrelation method, or (c) the Burg method. For example, the autocorrelation method proceeds as follows. First calculate the autocorrelation values $$R(k) = \sum_{m=0}^{M-1-k} s_I(m)s_I(m+k),$$

for k=0,1,2, where $s_I(m)=x(n+I)$ . Then solve the 2×2 linear system $$\begin{bmatrix} R(0) & R(1) \\ R(1) & R(0) \end{bmatrix} \begin{bmatrix} \alpha_1 \\ \alpha_2 \end{bmatrix} = \begin{bmatrix} R(1) \\ R(2) \end{bmatrix}$$

for $a_1$ and $a_2$.

In step 1115, a pair of reflection coefficients are calculated from the filter coefficients according to the equations $$k_1 = \alpha_1,$$

$$k_2 = \frac{\alpha_1}{1-\alpha_2}.$$

In step 1120, an energy value E is calculated in terms of the reflection coefficients according to the equation $$E = (1-k_1^2)(1-k_2^2).$$

In step 1125, a test is performed to determine whether or not the search for the energy minimizing index I is to be terminated. If the test determines that the search is to continue, step 1130 is performed and then the processing loop is reiterated starting with step 1110. In step 1130, the search index I is updated. Step 1130 compares the current energy and index value with previous energy values and their corresponding index values, and updates the search index I according to a search algorithm. In the preferred embodiment of step 1130, the downhill simplex method is used as the search algorithm. However, alternative embodiments of step 1130 are easily conceived which use other search algorithms.

If, in step 1125, the test determines that the search is to terminate, step 1135 is performed. In step 1135, the coefficients $a_1$ and $a_2$ of the energy minimizing filter are declared to be the optimal order-two inverse filter coefficients. In other words, the coefficients $a_1$ and $a_2$ of the energy minimizing filter are assigned to the coefficients $\hat{a}_1$ and $\hat{a}_2$ respectively which determine the optimal order-two inverse filter.

In the preferred embodiment of FIG. 11 (step 1015), the parameter M, which determines the size of speech segments, is chosen to be one-half (or one-third) of the pitch period determined from the previous speech frame (i.e. the speech frame prior to the frame currently being analyzed). Since the pitch period varies slowly from frame to frame, this choice for M ensures that M will be smaller than the pitch period of the current frame (i.e. the frame which is currently being analyzed).

In one alternate embodiment of FIG. 11, the parameter M is chosen to be a constant in the range from 10 to 30 samples.

In an alternate embodiment of FIG. 11 (i.e. step 1015), the search index I in step 1130 is $$I = I + \frac{\tilde{P}}{K},$$

previous speech frame, and K is a positive integer constant greater than or equal to two. In this $$\frac{(K-1)\tilde{P}}{K}.$$

embodiment, K=3 is a preferred value. Thus, the search index I successively takes the value $I_0$, $$I_0 + \frac{\tilde{P}}{3}, \text{ and } I_0 + \frac{2\tilde{P}}{3},$$

embodiment, $I_0$=0 is a preferred value.

Although the system and method of the present invention has been described in connection with the preferred embodiment, it is not intended to be limited to the specific form set forth herein, but on the contrary, it is intended to cover such alternatives, modifications, and equivalents, as can be reasonably included within the spirit and scope of the invention as defined by the appended claims.

What is claimed is:

1. A method for performing pitch estimation which prefilters speech data prior to pitch estimation, comprising:

receiving a frame of speech data comprising a plurality of speech samples;

determining an order-two inverse filter for said frame of speech data, wherein said determining uses said plurality of speech samples comprising said speech frame;

filtering said frame of speech data using said order-two inverse filter, wherein said filtering removes first formant signal information from said frame of speech data, wherein said filtering results in a filtered speech frame; and performing pitch estimation on said filtered speech frame to estimate a pitch value for said filtered speech frame;

wherein said pitch value is useable to represent the speech data in a compressed format.

2. The method of claim 1, wherein said determining an order-two inverse filter comprises:

computing a plurality of candidate order-two inverse filters at a plurality of locations in said frame of speech data;

computing an energy value for each of said candidate order-two inverse filters, wherein the energy value represents the proportion of signal energy that would be removed if the frame of speech data were filtered with the corresponding candidate order-two inverse filter; and choosing the candidate order-two inverse filter with minimum energy value.

3. The method of claim 2, wherein the computing of each of said candidate order-two inverse filters comprises analyzing a number of speech samples which span less than a full pitch period in time duration.

4. The method of claim 3, wherein said number of speech samples is determined using the pitch period estimated from a previous frame of speech data.

5. The method of claim 2, wherein the computing of each of said candidate order-two inverse filters comprises performing an order-two Linear Predictive Coding (LPC) analysis.

6. The method of claim 5, wherein said performing an order-two LPC analysis comprises applying the covariance estimation technique.

7. The method of claim 5, wherein said performing an order-two LPC analysis comprises applying the autocorrelation estimation technique.

8. The method of claim 5, wherein said performing an order-two LPC analysis comprises applying the Burg estimation technique.

9. The method of claim 2, wherein the computing of each of said candidate order two inverse filters produces a pair of filter coefficients $a_1$ and $a_2$, wherein a pair of reflection coefficients $k_1$ and $k_2$ are calculated according to the relations $$k_1 = \alpha_1,$$

$$k_2 = \frac{\alpha_1}{1-\alpha_2},$$

and wherein said energy value is calculated according to the equation $$E = (1-k_1^2)(1-k_2^2).$$

10. The method of claim 1, wherein said performing pitch estimation on said filtered speech frame comprises:

performing an autocorrelation on said filtered speech frame for a range of time-delay values;

applying a threshold to the peaks of said autocorrelation function; and analyzing the peaks of said autocorrelation function to estimate said pitch period.

11. A vocoder which pre-filters speech data prior to pitch estimation comprising:

an input for receiving a frame of speech data, wherein said frame of speech data comprises a plurality of speech samples; and at least one processor for analyzing said speech data and performing pitch estimation on said speech data;

wherein said at least one processor is operable to determine an order-two inverse filter for said frame of speech data, wherein said determination uses said plurality of speech samples comprising said speech frame;

wherein said at least one processor is further operable to filter said frame of speech data using said order-two inverse filter to remove first formant signal information from said frame of speech data, wherein said filtering results in a filtered speech frame;

wherein said at least one processor is further operable to perform pitch estimation on said filtered speech frame to estimate a pitch value for said filtered speech frame; and wherein said pitch value is useable to represent the speech data in a compressed format.

12. The vocoder of claim 11, wherein in performing said determination of said order-two inverse filter:

the at least one processor is operable to compute a plurality of candidate order-two inverse filters at a plurality of locations in said frame of speech data;

the at least one processor is operable to compute an energy value for each of said candidate order-two inverse filters, wherein the energy value represents the proportion of signal energy that would be removed if the frame of speech data were filtered with the corresponding candidate order-two inverse filter;

the at least one processor is operable to choose the candidate order-two inverse filter with the minimum energy value.

13. The vocoder of claim 12, wherein in said computing of each of said candidate order-two inverse filters the at least one processor analyzes a number of speech samples which span less than a pitch period in time duration.

14. The vocoder of claim 13, wherein said number of speech samples is determined using the pitch period estimated from a previous frame of speech data.

15. The vocoder of claim 12, wherein in said computing of each of said candidate order-two inverse filters the at least one processor performs an order-two Linear Predictive Coding (LPC) analysis.

16. The vocoder of claim 12, wherein in said computing of each of said candidate order two inverse filters:

the at least one processor produces a pair of filter coefficients $a_1$ and $a_2$; and the at least one processor calculates a pair of reflection coefficients $k_1$ and $k_2$ according to the relations $$k_1 = \alpha_1,$$

$$k_2 = \frac{\alpha_1}{1-\alpha_2};$$

and the at least one processor calculates said energy value according to the equation $$E = (1-k_1^2)(1-k_2^2).$$

17. The vocoder of claim 11, wherein in said performing pitch estimation on said filtered speech frame:

the at least one processor is operable to perform an autocorrelation on said filtered speech frame for a range of time-delay values;

the at least one processor is operable to apply a threshold to the peaks of said autocorrelation function; and the at least one processor is operable to analyze the peaks of said autocorrelation function to estimate said pitch period.

* * * * *